US008714098B2

(12) United States Patent
Webb et al.

(10) Patent No.: US 8,714,098 B2
(45) Date of Patent: May 6, 2014

(54) SHOCK ABSORBING DOCKING SPACER WITH FLUID COMPRESSION BUFFERING

(71) Applicants: John Thomas Webb, Oshawa (CA); Beverly Joanne Webb, Oshawa (CA)

(72) Inventors: John Thomas Webb, Oshawa (CA); Beverly Joanne Webb, Oshawa (CA)

( * ) Notice: Subject to any disclaimer, the term of this patent is extended or adjusted under 35 U.S.C. 154(b) by 0 days.

(21) Appl. No.: 13/724,850

(22) Filed: Dec. 21, 2012

(65) Prior Publication Data

US 2013/0160691 A1 Jun. 27, 2013

Related U.S. Application Data

(60) Provisional application No. 61/630,912, filed on Dec. 22, 2011.

(51) Int. Cl.
*B63B 21/00* (2006.01)

(52) U.S. Cl.
USPC ..... 114/230.18

(58) Field of Classification Search
CPC ..... B63B 21/00; B63B 2021/001
USPC ..... 267/64.23, 64.26, 64.27; 114/230.15–230.19
See application file for complete search history.

(56) References Cited

U.S. PATENT DOCUMENTS

| | | | | |
|---|---|---|---|---|
| 3,177,839 | A * | 4/1965 | Nolf | 114/230.18 |
| 3,752,270 | A * | 8/1973 | Valdespino | 188/281 |
| 3,804,446 | A * | 4/1974 | Warrener | 293/134 |
| 4,043,545 | A | 8/1977 | Dial et al. | |
| 4,063,526 | A | 12/1977 | Ueda | |
| 4,066,030 | A | 1/1978 | Milone | |
| 4,494,475 | A | 1/1985 | Eriksen | |
| 4,532,879 | A | 8/1985 | Ortloff | |
| 4,721,053 | A | 1/1988 | Brewerton | |
| 4,735,167 | A | 4/1988 | White et al. | |
| 4,756,267 | A | 7/1988 | Carr et al. | |
| 5,014,638 | A | 5/1991 | Ilves et al. | |
| 6,431,104 | B1 | 8/2002 | Webb | |
| 6,439,147 | B2 | 8/2002 | Cottrell et al. | |
| 6,910,435 | B2 | 6/2005 | Hadcroft et al. | |

* cited by examiner

*Primary Examiner* — Edwin Swinehart

(57) ABSTRACT

A shock absorbing docking spacer for connecting a vessel to a mooring structure and which includes first and second sections relatively telescopically movable longitudinally relative to one another so as to define a variable effective overall length for the docking spacer and wherein one section contains an airtight air bag and the air bag is connected to the other section such that as the first and second sections move relatively inwardly relative to one another the air bag provides a buffer for absorbing impact forces between the first and second sections brought about by ambient conditions.

17 Claims, 4 Drawing Sheets

SHOCK ABSORBING DOCKING SPACER WITH FLUID COMPRESSION BUFFERING

CROSS REFERENCE TO RELATED APPLICATIONS

This application is a non-provisional application claiming the filing priority benefit of U.S. Provisional Patent Application Ser. No. 61/630,912, filed Dec. 22, 2011, in the name to the current inventors and the contents of which are incorporated in their entirety herein be reference.

BACKGROUND OF THE INVENTION

1. Field of the Invention

The present invention relates to shock absorbing spacers or bumpers for connecting a boat or other vessel from a mooring, such as a dock, and more particularly to a spacer having a bag, bladder or other enclosure containing a fluid under pressure for protecting a vessel from impact with a dock, buoy or other mooring structure when the vessel is subjected to forces caused by waves, wind, tide and the like.

2. Brief Description of the Related Art

U.S. Pat. No. 6,431,104, issued on Aug. 13, 2002, in the name of John T. Webb, the contents of which are also incorporated in the entirety herein by reference, is directed to a shock absorbing spacer which functions to separate a boat tied to a mooring from impacting the mooring. The spacer uses a resilient length of cord, sometimes referred to as a "bungee cord" to act as a buffer or shock absorber as two cylinders are forced toward one another as a vessel secured to the spacer moves toward a mooring due to ambient conditions. One of the cylinders is attached to mooring such as a dock and the other is attached to a vessel such as a boat. The two cylinders are in telescopic relationship with one other and when the boat is subjected to the forces mentioned above, the inner cylinder slides into the outer cylinder thereby shortening the effective overall length of the spacer. The sliding is resisted by the bungee cord so that the spacer is never short enough to allow the boat to come into contact with the mooring.

In U.S. Pat. No. 4,043,545, issued Aug. 23, 1977, in the name of Darrell D. Dial et al, another form of cushioning unit or bumper for positioning between a boat or ship and a mooring, such as a dock, is disclosed wherein a piston rod is connected to a piston plate that is movable within a buffering cylinder and divide the buffering cylinder into separate interior portions. As ambient conditions urged a vessel towards its mooring, the piston plate is driven inwardly of the buffering cylinder such that compression of fluid within the buffering cylinder acts as a buffer on the forces being directed between the vessel and the mooring. During this compression period, compressed fluid is bled from the buffering cylinder through a plurality of ports which communicate with the interior of a secondary high pressure cylinder within which the buffering cylinder is mounted. As forces increase within the high pressure cylinder, they will act in an opposite direction to urge the piston face toward an opposite end of the buffering cylinder such that the piston rod is restored to its originally extended position relative to the vessel.

Other examples of cushioning or bumper devices used to dissipate forces tending to direct vessels either toward or away from mooring devices are disclosed in U.S. Pat. No. 4,063,526 to Ueda wherein inner and outer pressurized cylinders are used and U.S. Pat. No. 4,066,030 to Milone, wherein a hydraulic cylinder arrangement is provided with a male portion of the arrangement being vertically movable within a vertical guide track so that relative vertical movement of a vessel and a dock or mooring structure is accounted for simultaneously with the buffering of compressive and expansion forces. Another buffering or cushioning device for allowing for vertical movement between a vessel and a mooring structure is disclosed in U.S. Pat. No. 5,014,638 to Ilves et al.

SUMMARY OF THE INVENTION

A first embodiment of shock absorbing, cushioning device or docking spacer of the present invention for use in securing a boat or similar vessel to a mooring, such as a dock, includes an elongated body having a pair of sections movable longitudinally of each other in telescopic relationship to define a variable effective overall length. One of the sections is adapted to being attached to the boat while the other section is adapted to being attached to the dock. An airtight bag or bladder containing a pressurized fluid, and preferably a gas, is disposed within one section while a connecting rod extends from the bag to the other section. The connecting rod advances toward the bag upon impact of the boat with the shock absorber or docking spacer.

In a second embodiment of the invention, as opposed to a rod extending from one section and being connected to a pressurized bag or bladder in the other section, the shock absorbing, cushion device or docking spacer has one section having one end connected to one of a vessel or a mooring structure and another end connected to a first sealed end of a pressurized bag or bladder mounted within a second section of the shock absorber. In this embodiment, as the section connected to the vessel moves toward the mooring device, the first end of the bag or bladder is moved toward a second end thereof thereby building up pressure within the bag or bladder which build up of pressure buffers the force of the vessel moving toward the mooring structure. In this embodiment, a bumper device or resilient material may be provided on an inner end face of the movable section to thereby provide a resilient stop should the forces driving the sections toward one another cause an impact there between.

In both embodiments of the invention, the shock absorbing or spacer devices may be mounted to a slidable base secured to a vertical guide track structure which is mounted to a vertical post or other portion of the mooring device so that water levels change relative to the mooring structure, the slidable base will automatically be vertically adjusted. In this manner, transverse stresses on the sections of the shock absorbing or spacer devices will be reduced thereby allowing smoother reciprocal motion between the telescoping sections of the devices.

BRIEF DESCRIPTION OF THE DRAWINGS

A better understanding of the shock absorbing devices or docking spacers of the present invention will be had with reference to the accompanying drawings in which.

DESCRIPTION OF THE PREFERRED EMBODIMENTS

Figure 1:
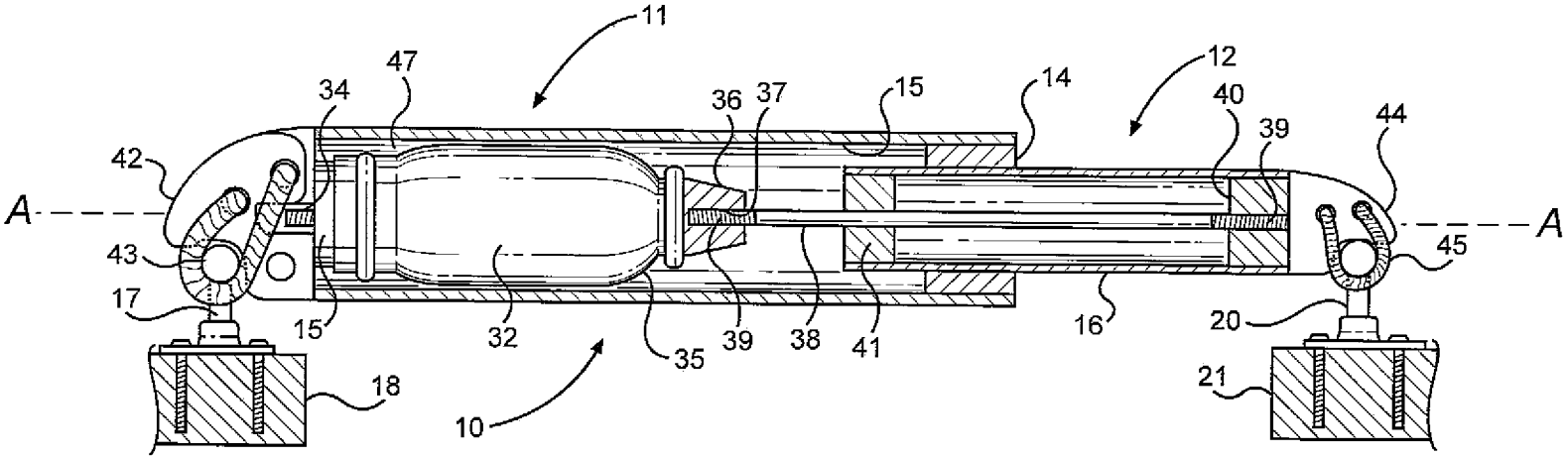
FIG. 1 is a side elevation view, primarily in section, of a shock absorbing device or docking spacer of a first embodiment of the present invention.

With reference to FIG. 1, a first embodiment of shock absorbing device or docking spacer 10 includes first and second hollow sections or cylinders, 11 and 12, respectively, which are moveable longitudinally of each other in a telescopic relationship along axis A-A of the first section with resulting changes in the effective overall length of the docking spacer. A bushing 14 is disposed between an inner wall 15 of the first section and the outer wall 16 of the second section for reducing friction between the two walls as they slide relative to each other.

Figure 2:
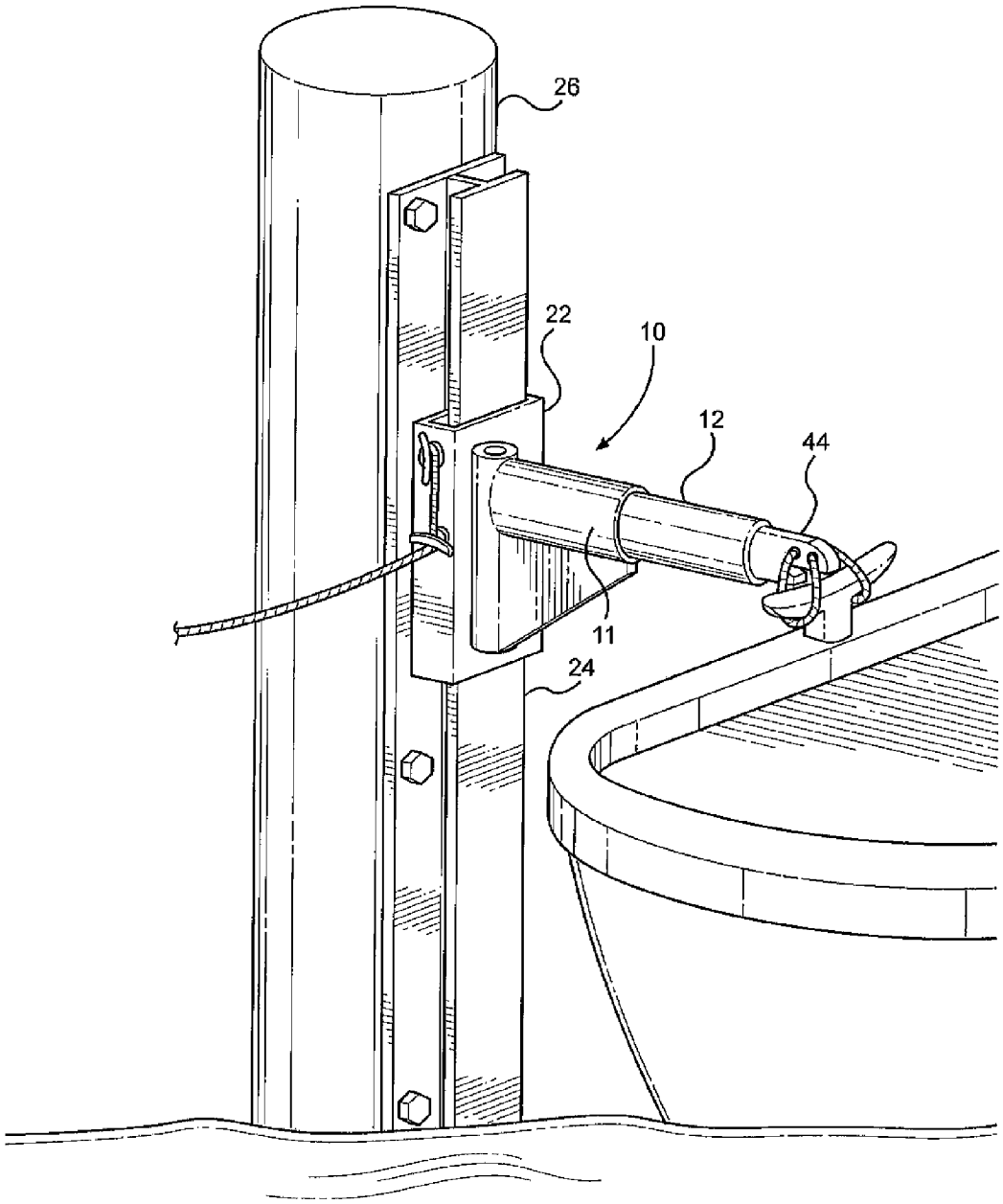
FIG. 2 is a front perspective view of the shock absorbing device or docking spacer of FIG. 1 attached to a mooring structure by way of a vertically movable base.
Figure 3A:
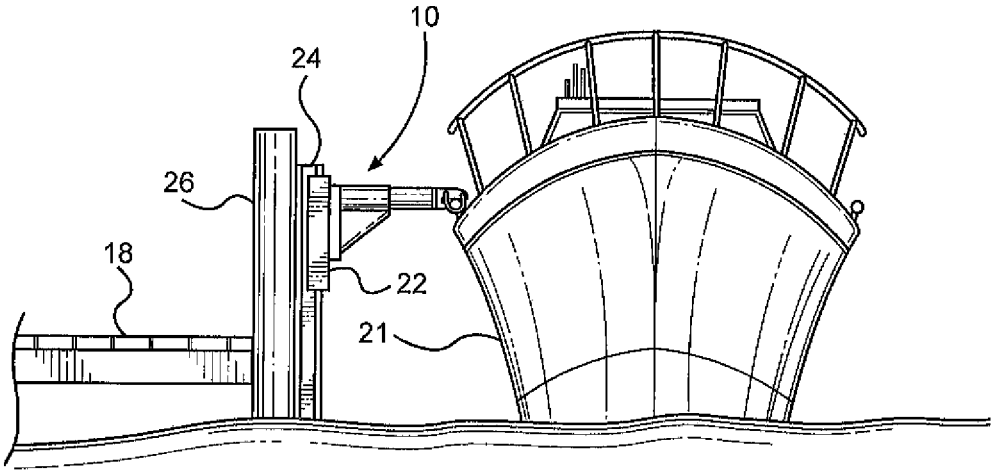
FIGS. 3*a* and 3*b* are illustrational views of the shock absorbing device or docking spacer with adjustable base of FIG. 2 and showing the relationship between a vessel and the mooring structure at high and low tides, respectively, and illustrating how the sections of the shock absorbing device remain horizontally aligned.
Figure 3B:
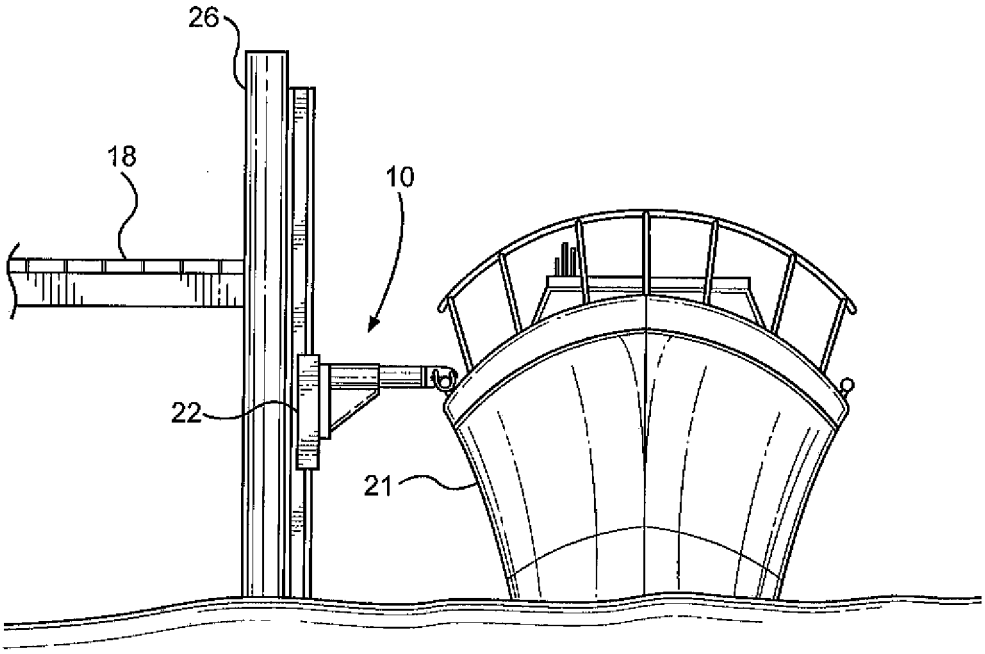

The first section 11 is connected to a cleat 17 which is attached to a dock 18 while the second section is connected to a cleat 20 which is attached to a boat 21. Alternatively and with reference to FIGS. 2, 3*a* and 3*b*, the first section may be connected to a base slider 22 which is mounted to slide vertically on a track or guide channel such as an I-beam 24. The I-beam is fastened to a vertical post 26 which is provided adjacent to, or which forms part of, the dock 18. The docking slider 22 allows the docking spacer 10 to move vertically so that the boat to which the docking spacer is attached is free to move up and down with the tide. This vertical adjustment reduces vertical transverse forces which can be created between the first and second cylinder sections 11 and 12 and the sections remain generally horizontally aligned regardless of the water level as shown in FIGS. 13A and 13B. Thus the sections will not bind when reciprocally moving relative to one another regardless of wave action.

Mounted within the first section 11 is a fluid-containing airtight bag or bladder 32. A valve 34 is attached to the bag to allow fluid under pressure to flow into the bag and for bleeding the fluid from it. A pressure gauge (not illustrated) measures the pressure within the bag. As shown, the valve 34 extends out from a proximal end of the first section.

The fluid flows to the bag from a high pressure cylinder (not illustrated). For reasons of economy, air is the preferred fluid and the air is contained in one or more conventional air cylinders. Other gases such as nitrogen or inert gases may also be used but generally are less suitable than air because of their cost. Liquids such as water can also be used but are generally not very suitable because of the cost of compressing them.

Attached to the distal end 35 of the bag which faces the second section 12 is a coupling 36 having a threaded socket 37 which receives one of two threaded ends 39 of a connecting rod or like connector 38. The opposite end of the connecting rod is threadably attached to a proximal end wall 40 of the second section, relative to the cleat 20. The connecting rod is also supported in a distal end wall 41 of the second section 12.

In use of the first embodiment, a hooked end member 42 connected to the proximal end of the first section 11 is secured, such as by a rope 43, to the cleat 17 of the dock 18 and a proximate hooked end member 44 connected to the proximal end of the second section 12 is secured to the cleat 20 of the vessel 21, also such as by a rope 45. The pressure within the air bag 32 is adjusted to provide a preferred buffering resistance to movement of the connecting rod 28 as ambient conditions force the second section 12 to move reciprocally relative to the first section. Such ambient conditions include forces caused by waves, wind, tide and the like. The greater the pressure within the air bag the less the buffering resistance to movement of the second section as such higher pressure resists compression of the air bag that is necessary to allow a buffered compression of the air bag to absorb the forces directed from the vessel toward the mooring dock.

Also, as shown in the drawings, in some forms of the first embodiment, some clearance 47 may be provided between the air bag 32 and the inner walls of the first section to allow for some initial expansion of the air bag without resistance from the walls of the first section.

Figure 4:
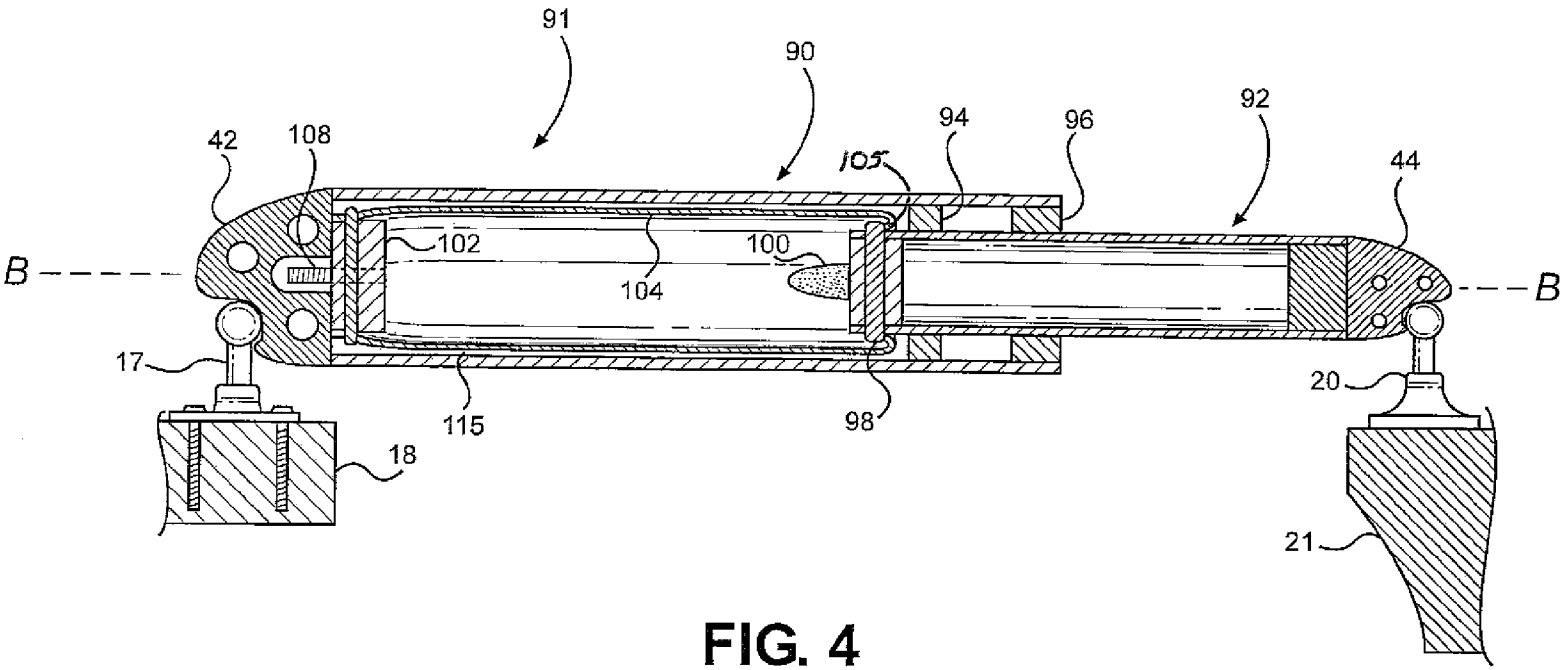
FIG. 4 is a side elevation view, primarily in section, of a shock absorbing device or docking spacer of a second embodiment of the present invention.

With reference to FIG. 4, a second embodiment of shock absorbing device 90 for connecting between a boat 20 and a mooring device such as a dock 18 is shown including outer and inner cylindrical sections, 91 and 92, respectively. Spaced bushings 94 and 96 are disposed in an annular gap between the two sections. The bushings act not only to close the gap but also act as guides for ensuring that the direction of the sliding motion of the second section 92 is along a longitudinal axis B-B of the first section 91. The outward movement of the second section relative to the first section is limited by a circular plate 98 at the distal end of the second section. The plate defines a forward or distal wall of the second section. The plate engages bushing 94 when an effective length of the mooring spacer is greatest. The inward movement the second section is limited by a bumper 100 which contacts proximal end wall 102 of the first section. When contact occurs, the effective length of the mooring spacer is the least.

An airtight bag 104 for compressed fluid is disposed within the first section. The bag is closed except for an opening defined by an edge 105 which is attached to plate 98. Thus as the second section slides inward toward end wall 102 of the first section, the plate draws the circular edge 105 and the air bag 104 inward toward the end wall 102 with resulting compression of fluid within the bag. Fluid may be introduced into the bag or bled from it through a valve 108 adjacent to the proximal end wall 102 of the first section.

In use of the second embodiment, a hooked end member 42 connected to the proximal end of the first section 91 is secured, such as by a rope, not shown, to the cleat 17 of the dock 18 and a proximate hooked end member 44 connected to the proximal end of the second section 92 is secured to the cleat 20 of the vessel 21, also such as by a rope, not shown. The pressure within the air bag 104 is adjusted to provide a preferred buffering resistance to movement of the second section 92 toward the proximal end 102 of the first section 91 as ambient conditions force the second section 92 to move reciprocally relative to the first section 91. Such ambient conditions include forces caused by waves, wind, tide and the like The greater the pressure within the air bag, the less the buffering resistance to movement of the second section as such higher pressure resists compression of the air bag that is necessary to allow a buffered compression of the air bag to absorb the forces directed from the vessel toward the mooring deck.

Also, as shown in the drawings, in some forms of the second embodiment, some clearance 115 may be provided between the air bag 104 and the inner walls of the first section 91 to allow for some initial expansion of the air bag without resistance from the walls of the first section.

It will be understood, of course, that modifications can be made in the structure of the shock absorbing devices and docking spacers of the invention without departing from the scope and purview of the invention as defined in the claims that follow.

We claim:

1. A shock absorbing docking spacer for securing a water borne vessel relative to a mooring structure while allowing buffered movement of the vessel relative to the mooring structure, the docking spacer comprising;

an elongated body having first and second sections moveable longitudinally of each other in telescopic relationship to define a variable effective length to the body, a first hook end member on one of the first and second sections having a rope connected thereto for attaching the first hook end member to a mooring structure or a vessel, a fluid containing airtight bag mounted completely within the first section, the bag being compressible when conditions force the first and second sections relatively toward one another whereby pressure within the bag buffers movement of the first and second sections toward one another.

2. The shock absorbing docking spacer of claim 1 wherein the first and second sections are cylindrical and have co-linear longitudinal axes, and the second section being disposed within the first section.

3. The shock absorbing docking spacer of claim 2 further including a valve connected to the bag for allowing a variation of pressure of the fluid within the bag.

4. The shock absorbing docking spacer of claim 1 further including a valve connected to the bag to facilitate the selective introduction of fluid into the bag and the extraction of the fluid from the bag.

5. The shock absorbing docking spacer of claim 2 including a connector attached to the bag, a rod mounted to the second section and having an end extending from the second section and which end is secured to the connector.

6. The shock absorbing docking spacer of claim 2 wherein the bag is secured to a distal end of the second section.

7. The shock absorbing docking spacer of claim 6 wherein a bumper is mounted on the distal end of the second section so as to be in opposing relationship to a proximal end of the first section.

8. The shock absorbing docking spacer of claim 6 wherein the mooring structure includes a slider mounted to move vertically along a vertically oriented guide, and a proximal end of the first section is secured to the slider.

9. The shock absorbing docking spacer of claim 5 wherein the mooring structure includes a slider mounted to move vertically along a vertically oriented guide, and a proximal end of the first section is secured to the slider.

10. The shock absorbing docking spacer of claim 2 wherein the mooring structure includes a slider mounted to move vertically along a vertically oriented guide, and a proximal end of the first section is secured to the slider.

11. The shock absorbing docking spacer of claim 6 wherein the mooring structure includes a slider mounted to move vertically along a vertically oriented guide, and a proximal end of the first section is secured to the slider.

12. A shock absorbing docking spacer for separating a vessel from a mooring structure comprising:

an elongated body having first and second sections, the second section being reciprocally movable within the first section such that the body has a variable effective length;

a first hook end member on one of the first and second sections having a rope connected thereto for attaching the first hook end member to a mooring structure or a vessel a fluid-containing airtight bag completely disposed within the first section and being attached to the second section, the first section having a proximal end wall and a hollow interior in which a forward portion of the second section slides, and the second section having a forward distal wall which advances toward the proximal end wall upon force urging the first hook end member toward the second hook end member.

13. The shock absorbing docking spacer of claim 12 wherein the first and second sections are cylindrical and have co-linear longitudinal axes, the first section being disposed radially outward of the second section.

14. The shock absorbing docking spacer of claim 12 further including valve means for introducing and exhausting fluid from the bag.

15. The shock absorbing docking spacer of claim 12 wherein the forward distal end wall of the second section is attached to the bag.

16. The shock absorbing docking spacer of claim 15 wherein a bumper is mounted on the forward distal end of the second section so as to be in opposing relationship to the proximal end of the first section.

17. The shock absorbing docking spacer of claim 12 wherein the mooring structure includes a slider mounted to move vertically along a vertically oriented guide, and a proximal end of the first section is secured to the slider.

* * * * *